US005850879A

United States Patent [19]

Smith

[11] Patent Number: 5,850,879

[45] Date of Patent: Dec. 22, 1998

[54] METHOD OF COMMINICATING DATA THROUGH A SLICKLINE OF OTHER SINGLE CABLE SUSPENSION ELEMENT

[75] Inventor: Elbert Juan Smith, Garland, Tex.

[73] Assignee: Halliburton Energy Services, Inc., Dallas, Tex.

[21] Appl. No.: 868,368

[22] Filed: Jun. 3, 1997

[51] Int. Cl.[6] ..... E21B 47/01

[52] U.S. Cl. ..... 166/250.01; 166/66

[58] Field of Search ..... 166/297, 250.01, 166/55.1, 66

[56] References Cited

U.S. PATENT DOCUMENTS

| | | | |
|---|---|---|---|
| 3,664,416 | 5/1972 | Nicolas et al. | 166/66.4 |
| 3,855,853 | 12/1974 | Claycomb | 175/40 X |
| 5,191,936 | 3/1993 | Edwards et al. | 166/297 |
| 5,305,830 | 4/1994 | Wittrisch | 166/250.01 |
| 5,318,125 | 6/1994 | Wittrisch | 166/277 |
| 5,353,872 | 10/1994 | Wittrisch | 166/250.01 |
| 5,361,838 | 11/1994 | Kilgore . | |
| 5,377,540 | 1/1995 | Songe, Jr. . | |
| 5,456,316 | 10/1995 | Owens et al. . | |

OTHER PUBLICATIONS

Otis Engineering Corporation, Dallas, Texas, U.S.A., Wireline Surface Equipment, 1989.

M/D TOTCO Instrumentation, Tension Load Links catalog.

M/D TOTCO Instrumentation, Load Pins catalog.

ASEP, K–WINCH Model 20025.

*Primary Examiner*—Frank Tsay

*Attorney, Agent, or Firm*—Paul I. Herman; John F. Booth

[57] ABSTRACT

Disclosed is a method of communicating data and control signals between a down hole well tool and surface equipment wherein variations in the tension of the line supporting the tool from a reference tension value established with the well tool in place for operation are imposed at one location on the support line and detected at another location on said support line said variations in tension being coded in frequency, magnitude, polarity or duration or combinations thereof to convey the data and control signals between the two locations.

19 Claims, 4 Drawing Sheets

METHOD OF COMMINICATING DATA THROUGH A SLICKLINE OF OTHER SINGLE CABLE SUSPENSION ELEMENT

FIELD OF INVENTION

The present invention relates to actuation of down hole well tools and the transmission of information and commands between the tool and surface equipment particularly by means of mechanical signals conducted through a wire or slickline suspension element.

BACKGROUND OF INVENTION

In the operation of petroleum wells it is at times necessary to position a tool for data gathering or other purposes at a vertical location in the well and then to actuate the tool. It is desirable to monitor the data acquired by the tool while the tool remains in the well. It is often necessary to reposition the tool to a different location down hole and acquire additional data without removing the tool from the well.

In some systems actuation of the tool is by means of a pressure sensor triggered when pressure down hole exceeds a predetermined level. In other systems an accelerometer with a time delay is used to activate the tool when no motion has been detected for a predetermined period of time. Other systems use established profiles in the well to set and actuate the tools. However, such systems are only useful when profiles are present in the completed well. In such systems the tool becomes supported in the recessed profile with the resulting weight shift actuating the tool as shown, for example, in U.S. Pat. No. 5,361,838 for slickline casing and tubing joint locator apparatus and associated method.

Some systems use electrical or electronic signals transmitted by insulated wire conductors to send data between the tool and surface equipment. Such systems may be costly, require special tools and specially trained personnel and may require extra storage space which often is at a premium.

In another system actuation of down hole tools is accomplished by inducing motion in the wire line or slickline as shown in U.S. Pat. No. 5,456,316 Downhole Signal Conveying System. The tool monitors motion for predetermined patterns. Detection of a predetermined pattern actuates performance of a desired function. The tool may then transmit stored information to the surface by means of a mechanical signal embodied in a shift of the resonant frequency of the cable without using a conducting cable.

SUMMARY OF INVENTION

According to the present invention the well tool is equipped with a latch mechanism allowing the tool to be anchored at any desired point in the well tubing. The latch mechanism may be activated to anchor the tool in place by any of the systems or methods previously referred to. With the tool thus anchored the tension on the wire or slickline can be manipulated from the surface by increases or decreases from the normal of "hang weight" tension exerted on the wire. The tool senses a coded pattern of tension changes and is programmed to appropriately operate or respond. After actuation of the tool by cable tension changes, data is gathered and transmitted to the surface by the tool in a coded pattern of tension changes produced by a mechanism within the tool in response to the data acquired. By adding a "bias tension" above the "hang weight" tension on the wire, communication by tension changes becomes more reliable.

BRIEF DESCRIPTION OF THE DRAWINGS

The specific objects and advantages of the invention and its salient features will become apparent from the following detailed description when read with reference to the accompanying drawings wherein.

DETAILED DESCRIPTION OF A PREFERRED AND OTHER EMBODIMENTS OF THE INVENTION

Figures 1, 2, 3:
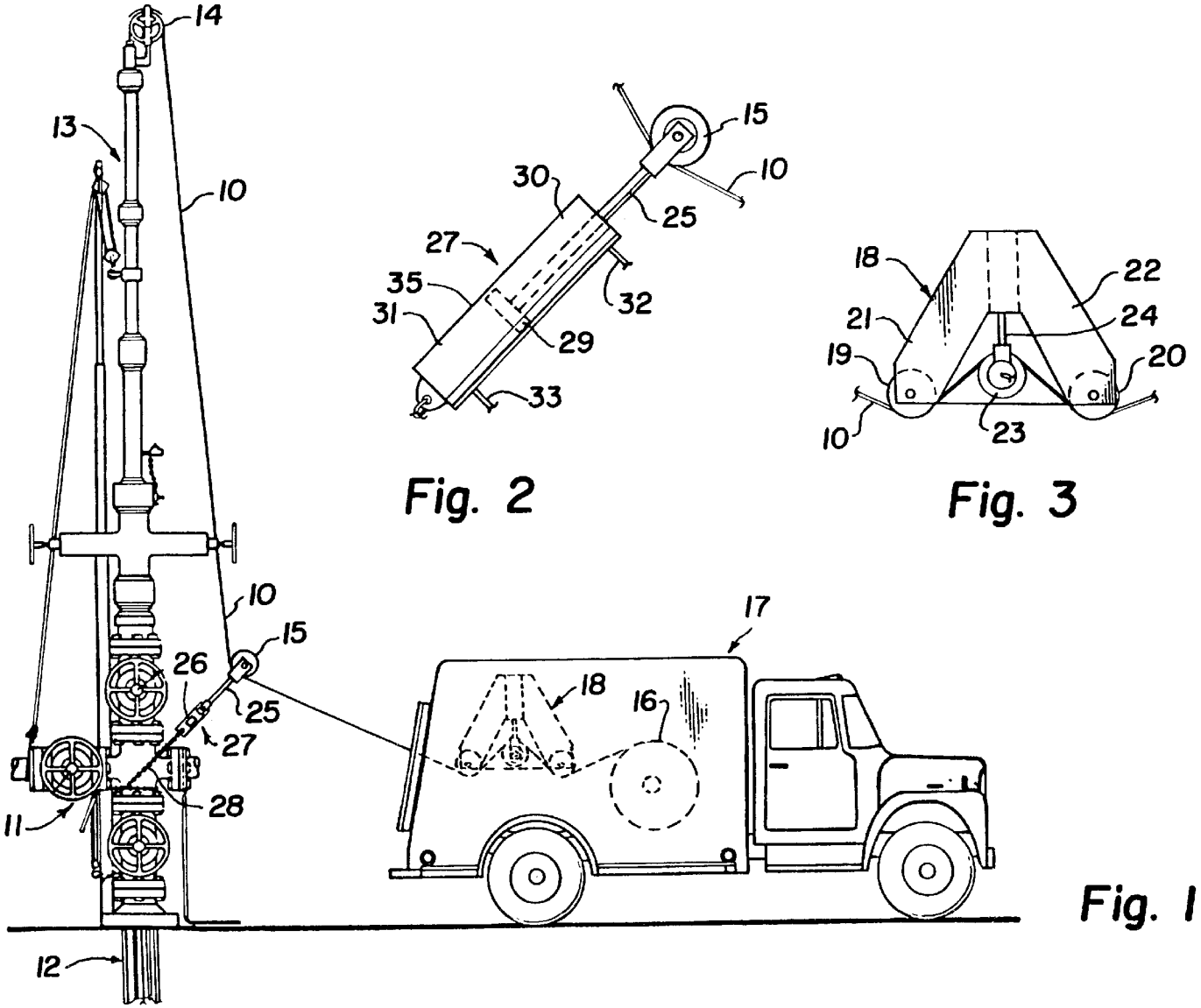
FIG. 1 illustrates the basic surface equipment of the type normally used to perform slickline work on a well as modified to accommodate the present invention.
FIG. 2 shows a load cell suitable for use in the present invention to measure line tension as connected between the slickline lower pulley and the well head structure.
FIG. 3 shows one form of wire tensioning device suitable for use with the present invention.

Referring now to FIG. 1 there is shown diagrammatically basic surface equipment of the type often used to service and collect data from an oil/gas well as modified for use with the present invention. The equipment uses a single non-conducting wire, cable or slickline 10 to lower a service tool through the well head structure or "Christmas tree" 11 into the well hole 12. The equipment may comprise a stanchion structure 13 attached to the well head 11 providing access to the well bore 12 for inserting, raising, lowering and communicating with a well tool (not shown).

Wire 10 attached to and supporting the well tool extends out of the stanchion 13 over the upper pulley 14 around the lower pulley 15 anchored to the well head and a storage reel 16 housed in a service truck (or other structure) 17. The reel 16 may be mechanically or hydraulically driven in the usual manner to raise and lower the tool in the well hole 12. Any suitable power source may be used such as an electric motor or diesel engine.

Also provided in the service truck 17 is a surface end wire tensioning device designated generally as 18. As shown in more detail in FIG. 3 the wire tensioning device 18 may take the general form of or be combined with a three pulley odometer if the wire odometer is not otherwise a part of reel 16 and its drive mechanism.

As illustrated in FIG. 3 the wire tensioning device may comprise a pair of pulleys 19 and 20 with their axles journalled respectively in fixed legs 21 and 22 extending from the main frame of the tensioning device, not shown. A third pulley 23 is mounted for rotation on a moveable powered arm 24. Arm 24 is driven preferably hydraulically in a vertical plane to move pulley 23 up or down relative to pulleys 19 and 20. Thus, with the wire line 10 threaded through the tensioning device 18 passing under pulleys 19 and 20 and over pulley 23 the tension on wire 10 is changed when the tensioning arm 24 is moved up or down.

The amount of tension in the slickline 10 and any change thereof is transmitted through pulley 15 and the arm 25 on which it is mounted to sensor 27 that may be used to anchor the lower pulley 15 to the well head 11 such as with chain 28 or other means. Tension sensor 27 may be of any suitable type but preferably is a load cell or link 26 which may be any of the various suitable types available from M/D TOTCO instrumentation of Cedars Park, Tex. and others. Alternatively, the tension sensor 27 may take the form of a load pin 34 inserted in place of the pulley shaft of pulley 15 or of the pulley shaft of pulley 14.

FIG. 2 shows another form of tension sensor 27 suitable for some applications of the present invention. In FIG. 2 the tension sensor 27 is a fluidic element 35. In element 35 pressure changes across piston 29 in upper and lower cylinders 30 and 31, respectively, are signaled through output elements 32 and 33 to pressure sensors not shown but well know in the industry.

The various necessary operating controls, motor controls, signal processing devices, all of which may be of types well known to those skilled in the art, are or may also be housed in the service truck 17.

Figure 4A:
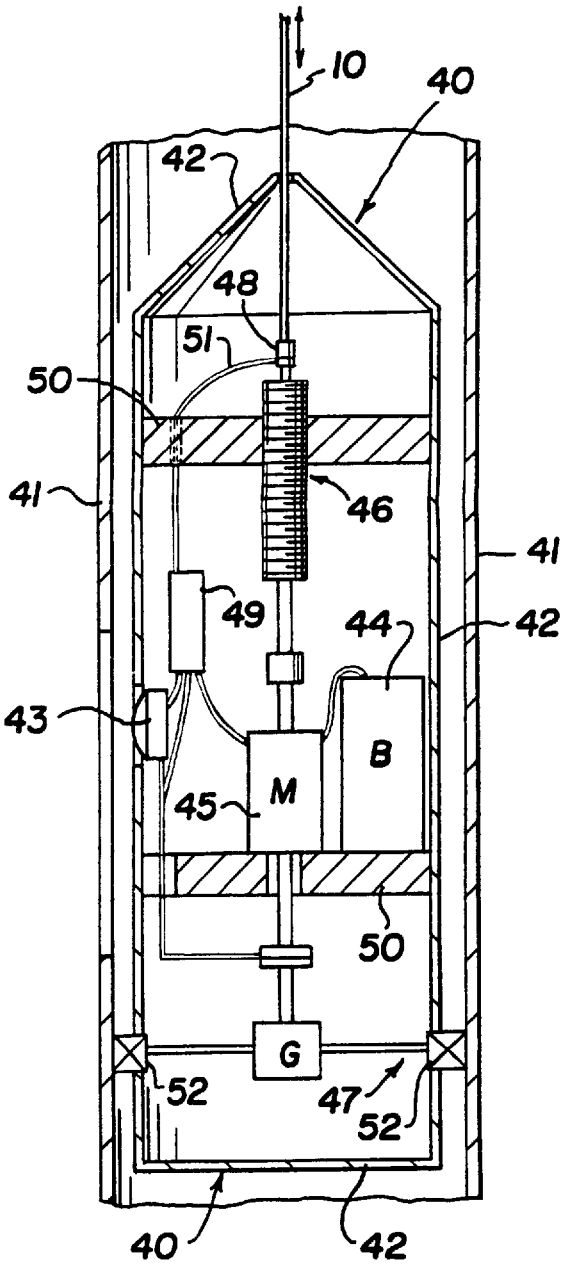
FIG. 4*a* is a diagrammatic illustration of the down hole tool of the present invention locked in place in the well.

Turning now to FIG. 4*a* there is diagrammatically illustrated a typical down hole tool 40 of the type useful in the present invention. The tool 40 is shown suspended by slickline 10 within the well tubing string or casing 41. Within the tool housing 42 are various transducers, detectors and measurement devices and signal processors (represented at 43) used to collect well data. Also present in the tool are the elements used to control the tool, transmit and receive data and control signals between the tool 40 and surface equipment in the service truck 17. These elements include a power source such as battery 44, motor 45, tensioning mechanism 46, a latch mechanism 47, a load cell 48 to detect line tension and a signal encoder/decoder/control electronics element 49 to translate data and instruction signals in the form of line tension variations. All of these elements of this inventive combination comprise devices of the type well known in the industry as useful in down hole tools.

In any down hole data gathering or well treatment operation the basic steps comprise inserting the tool into the well, positioning the tool within the well to carry out the desired operation, initiating and terminating or detecting automatic termination of each operation to be performed, moving the tool to another position within the well for further operations and/or removing the tool from the well when all of the desired operations have been performed.

According to the present invention the communications between surface equipment and the tool down hole that are necessary to initiate and control the operation of the tool and to recover information from the tool are provided by variations in the tension of the single slickline wire or cable holding the tool.

The tool 40 is attached by means of the tensioning mechanism 46 to the wire 10 through load cell 48. The tensioning mechanism 46 may comprise a ball screw or other suitable device to lengthen or shorten the linkage between the wire line 10 and the tool frame 50 to which it is attached. Other examples of power sources to change wire line tension include a pretensioned spring device as illustrated in FIG. 4*b* or a stored pressure fluid source as shown in FIG. 4*c*.

Figure 4B:
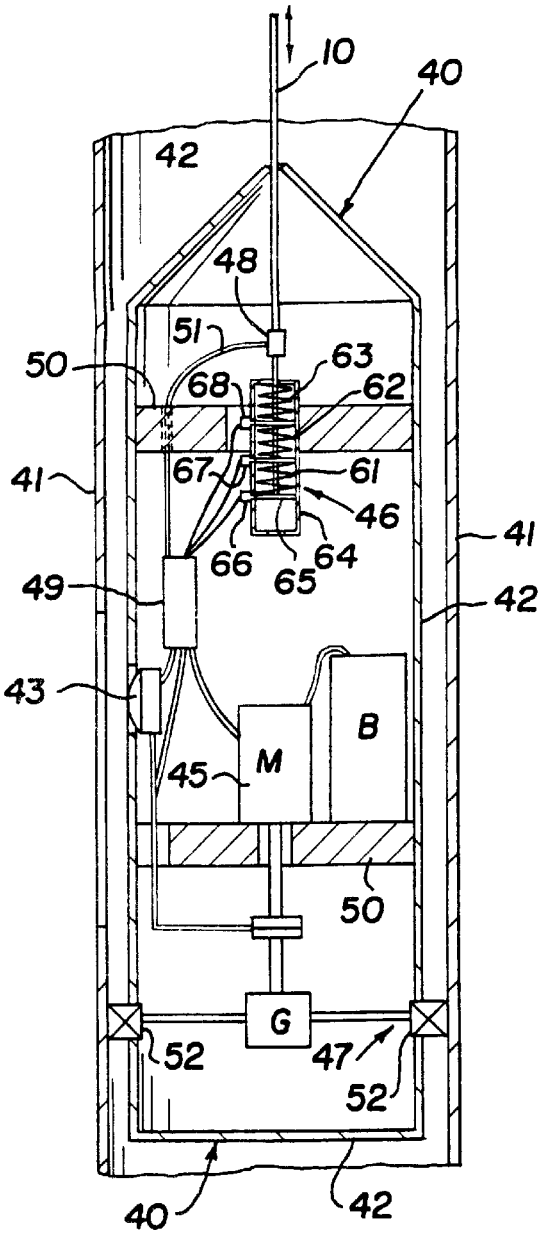
FIG. 4*b* is a diagrammatic illustration of the down hole tool of the present invention using a spring-powered type of alternative tensioning mechanism.
Figure 4C:
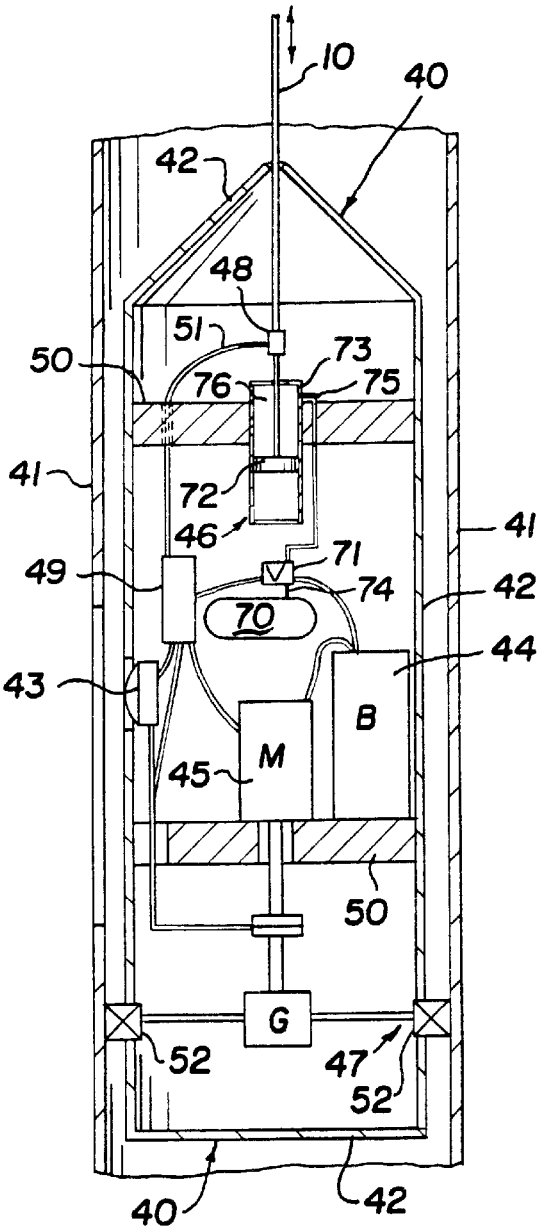
FIG. 4*c* is a diagrammatic illustration of the down hole tool of the present invention using a pneumatically-powered type of alternative tensioning device.

In the tensioning device 46 used in FIG. 4*b* a series of spring mechanisms 61, 62, and 63 are held in compression within a containing element 64. Line 10 is anchored to plate 65 below the spring element 61–63 and slidable within container 64. Spring mechanism 61, 62, and 63 are held in compression by solenoid-operated latches 66, 67, and 68 respectively. The latches 66–68 are controlled by the control electronics element 49.

When a step increase in tension is to be provided, bottom latch 66 is operated to release the compression of spring element 61 to apply tension force through plate 65 to line 10. Operation of latch 67 to release spring 62 applies additional tensioning force to line 10. Operation of latch 68 to release spring 63 adds still more tensioning force to line 10.

At any time or after all of the spring elements have been released the spring elements can be reset by using the storage reel 16 drive mechanism to pull line 10 and move plate 64 upward to again compress the springs and then by appropriate operation of the latches to hold them in compression.

The tension increases can then again be sequenced.

In the tensioning device 46 illustrated in FIG. 4*c* a compressed gas source, tank 70, holds a supply of nonflammable operating gas, such as nitrogen. The lower end of line 10 is connected to piston 72 movable within the pneumatically sealed cylinder 73. When it is desired to increase the tension in line 10 the control electronics element 49 operates valve 71 to allow a metered amount of pressurized gas to flow through line 74 and 75 into the upper chamber 76 of cylinder 73. The resulting downward pressure on piston 72 increases the tension on line 10.

The amount of tension increase is programmed into and controlled by the electronic element 49. The tension increase is controlled by the length of time valve 71 is held open relative to the gas pressure in the source tank 70, the size of the pneumatic cylinder 73 and the lines 74 and 75.

The gas in chamber 76 can be released by opening an exhaust port in valve 71 after a programmed predetermined time period subsequent to each tension increase to provide a series of timed signals of a constant or varying amplitude.

Alternatively, the system can be operated to provide a series of step signals by admitting additionally pressurized gas into chamber 76 in a coded pattern without releasing gas already in the chamber.

Alternatively, the sysetm can be operated to provide a series of step signals by admitting and removing pressurized gas into and out of the chamber 76 in a coded pattern.

The wire line tension and changes therein are communicated to the electronic package 49 via electrical cable 51.

In operation the method of the present invention is carried out as follows.

The tool 10 is lowered through the well tubing string by playing out the slickline from the supply reel 16 in the service truck. The location of the tool down the well is monitored and the tool is positioned by any of the well known means not requiring electrical connection to the surface. Such a system is described in U.S. Pat. No. 5,361,838 issued Nov. 8, 1994 to Marion D. Kilgore for Slickline Casing and Tubing Joint Locator Apparatus and Associated Methods, which is incorporated herein by reference for all purposes.

Once the tool has been positioned at the desired depth location in the well it is anchored in place in the tubing string. This may be accomplished by latching the tool into a profile that is part of the tubing string as is well known. Another way of anchoring or latching the tool 40 in position in the string 41 is by activating slips 52 shown as motor driven in FIG. 4. Activation of the latching mechanism 47 may be by timers, counters, accelerometers or other mechanisms of types well known located in the tool housing 42.

Once the tool is latched in the well string 41, tension on the slickline 10 can be manipulated. First tension is increased by tensioning device 18 at the surface to establish a certain tension value above the "hang weight" tension on the line as the "zero reference." Thereafter, patterned tension changes can be introduced into the slickline by tensioning device 18 at the surface to initiate and/or control test procedures to be carried out by the tool. Tension change patterns are also applied by the tensioning mechanism 46 in the tool down hole to signal operation progress or to transmit data from tests performed.

Figure 5:
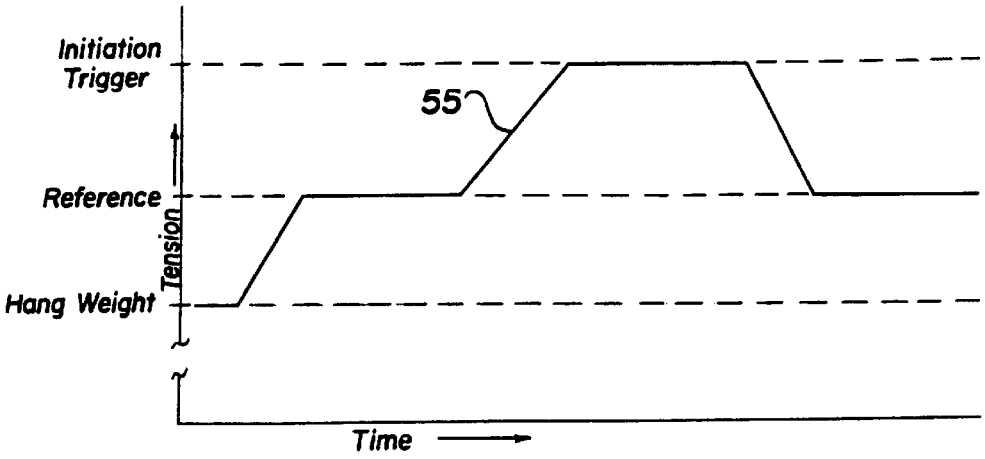
FIGS. 5, 6 and 7 are time versus tension graphic plots illustrating tension shift signals of the type used to transmit data and operating instructions between surface equipment and the down hole tool according to the present invention.

The "hang weight" tension on the slickline when the tool reaches its desired depth or position cannot be precisely predicted or controlled because of the varying conditions such as a deviation of the tubing string 41 along its length and/or rubbing of the slickline 10 on the inside of the tubing 41 itself or against accumulations such as scale, paraffin, debris in the tubing, or against other devices in the well. Nevertheless, it has been found that with a wire length/tool depth of 10,000 feet, a 0.092 inch diameter wire must be stretched approximately 62 inches to produce a tension increase of 100 pounds. While wire stretches in this range can be accomplished relatively easily with surface equipment, they are difficult to achieve by mechanisms in the tool down hole. Thus, instructions and operating signals from the surface to the tool may be encoded as relatively large sometimes sustained changes in tension from the established reference such as shown for example by the curve 55 in FIG. 5.

Figure 6:
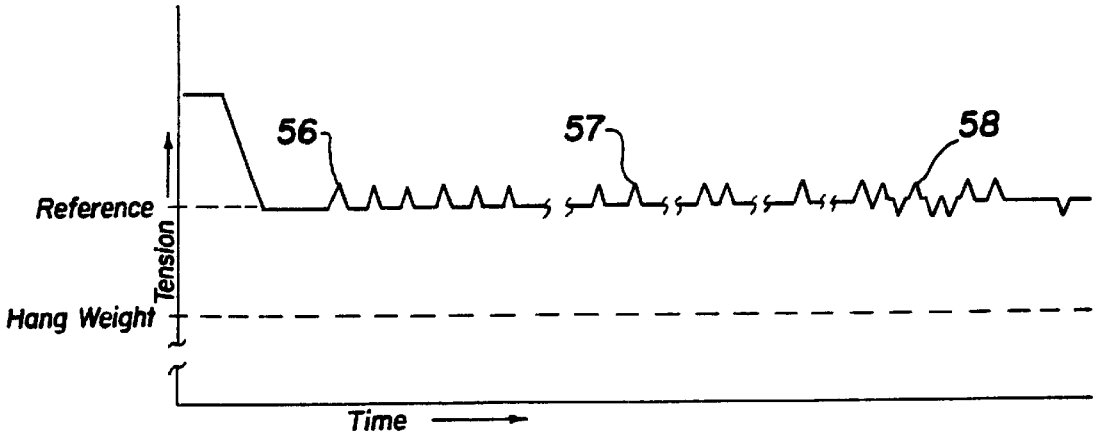
Figure 7:
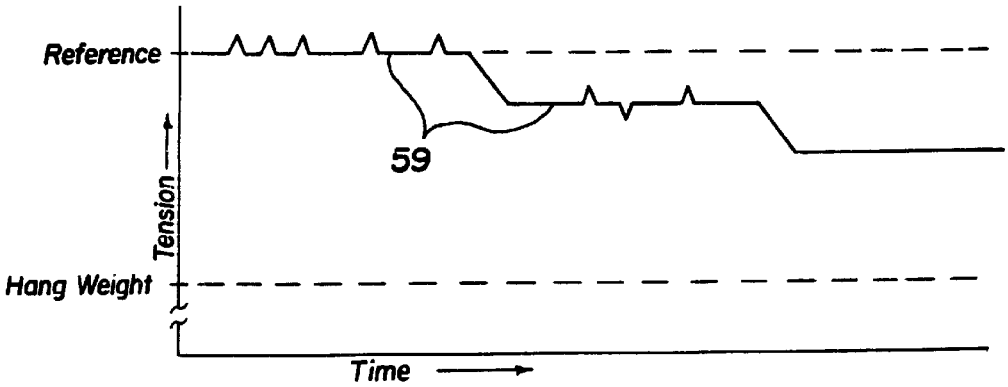

Alternatively, data or other signals from tool to surface may take a digital form such as a series of relatively small changes in the tension that convey information by their frequency, as shown on curve 56, by their relative spacing, as shown on curve 57, their polarity such as illustrated by curve 58 in FIG. 6 or other coding schemes. The tension changes may be only about 1/10 to 1/20 the magnitude of those induced by the surface tensioning device. Since a high rate of transmission is not required for data, a ball screw or any other relatively small and slow device is suitable for use within the tool as tensioning mechanism 46. Further, it is possible if desirable to superimpose data signals on reference signals of various levels as a means of identifying the type or source of data as illustrated for example by curve 59 in the graph of FIG. 7.

Thus, there has been disclosed a method of communicating data and instruction signals between surface equipment and a down hole well tool through variations in the tension in a non-electrical wire or slickline used to support and transport the tool within the well.

The foregoing detailed description is to be clearly understood as being given by way of illustration and example only; the spirit and scope of this invention being limited solely as set forth in the following claims.

I claim:

1. A method of communicating data and control signals between a down hole well tool and surface equipment comprising the steps of:

suspending a well tool in a well by an elongated support member extending between the tool and surface equipment;

anchoring said well tool to a well tubing string at a location within the well where the tool is to be operated;

imposing on said support member tension in excess of that resulting from the weight of said tool and of said support member to establish a reference value tension in said support member;

inducing at a first location on said support member variations in tension from said reference tension in a pattern in accordance with data/control signals to be transmitted; and detecting said variations in tension at another location on said support member.

2. The method of claim 1 wherein said variations in tension are of less magnitude than the tension imposed to establish said reference tension value.

3. The method of claim 1 wherein the tension imposed on said support member to establish a reference tension value is imposed by the surface equipment.

4. The method of claim 1 wherein said variations in tension are induced in said support member at the tool and are detected at the surface equipment.

5. The method of claim 3 wherein said variations in tension are induced in said support member at the tool and are detected at the surface equipment.

6. The method of claim 5 wherein said variations in tension are of less magnitude than the tension imposed to establish said reference tension value.

7. A method of communicating data and control signals between a down hole well tool and surface equipment comprising the steps of:

suspending a well tool in a well by an elongated support member extending between the tool and the surface equipment; and positioning the tool within the well to a location at which the tool is to be operated;

anchoring the tool within the well;

imposing on said support member through operation of said surface equipment added tension to establish a reference tension value in excess of the tension on said support member produced by the weight of said tool and of a supporting length of said support member;

initiating operation of said tool;

inducing in the support member at the tool variations in tension on the support member from said reference tension value in a pattern in accordance with data signals to be communicated to the surface equipment over a period of time; and detecting said tension variations in said support member at the surface equipment.

8. The method of claim 7 further comprising the steps of:

imposing on said support member through operation of said surface equipment a change from the reference tension of a magnitude of the tension previously added thereby and greater than the magnitude of the tension variations induced at the tool, said change in tension being sustained over a second period of time relatively longer than said period of time of said induced variations; and detecting at the tool said change from the reference tension in said support member and modifying the operation of the tool in response to the detection of said change.

9. The method of claim 7 wherein the step of initiating operation of said tool includes the steps of:

imposing on said support member through operation of said surface equipment a change in tension from the established referenced tension over a sustained period of time;

detecting at the tool said change in tension over a sustained period of time; and initiating operation of said tool in response to the detection of said change in tension.

10. A method of communicating data and control signals between a down hole well tool and surface equipment comprising the steps of:

suspending a well tool in a well by an elongated support member extending between the tool and the surface equipment;

anchoring the tool within the well at the location where the tool is to be operated;

imposing on said support member tension of a magnitude to establish a reference value tension;

inducing at a first location on said support member variations in tension from said reference value tension, said variations being encoded patterns representative of the data and control signals to be communicated; and detecting said variations at another location on said elongated support member.

11. The method of claim 10 further comprising the steps of:

imposing on said support member a unique patterned tension variation;

detecting said uniquely patterned tension variation at said tool and disengaging said tool from said anchoring location in response to said detecting;

moving said tool to a different location within said well and re-anchoring said tool at said different location; and repeating the steps of imposing tension on said support member to establish a reference value tension, inducing variations in tension in said support member at one location and detecting said variations and tension at another location on said support member.

12. The method of claim 2 wherein said variations in tension are induced by means comprising a compressed gas actuated cylinder.

13. The method of claim 2 wherein said variations in tension are induced by means comprising compressed spring elements.

14. The method of claim 4 wherein said variations in tension are induced by means comprising a compressed gas actuated cylinder.

15. The method of claim 4 wherein said variations in tension are induced by means comprising compressed spring elements.

16. The method of claim 7 wherein said variations in tension are induced by means comprising a compressed gas actuated cylinder.

17. The method of claim 7 wherein said variations in tension are induced by means comprising compressed spring elements.

18. The method of claim 11 wherein said variations in tension are induced by means comprising a compressed gas actuated cylinder.

19. The method of claim 11 wherein said variations in tension are induced by means comprising compressed spring elements.

* * * * *

UNITED STATES PATENT AND TRADEMARK OFFICE

CERTIFICATE OF CORRECTION

PATENT NO. : 5,850,879
DATED : December 22, 1998
INVENTOR(S) : Elbert Juan Smith It is certified that error appears in the above-identified patent and that said Letters Patent is hereby corrected as shown below:

Title page, item [54] and col. 1, lines 1-2,

In the title, line 1 change "COMMINICATING" to --COMMUNICATING--; and

In the title, line 2 change "OF" to --OR--.

Signed and Sealed this

Twenty-fourth Day of October, 2000

*Attest:*

*Attesting Officer*

Q. TODD DICKINSON

*Director of Patents and Trademarks*